United States Patent [19]

Ichiyama et al.

[11] Patent Number: 4,552,596

[45] **Date of Patent: * Nov. 12, 1985**

[54] GRAIN-ORIENTED ELECTROMAGNETIC STEEL SHEET WITH IMPROVED WATT LOSS

[75] Inventors: Tadashi Ichiyama, Sagamihara; Shigehiro Yamaguchi, Fujisawa; Tohru Iuchi, Kawasaki; Katsuro Kuroki, Kitakyushu, all of Japan

[73] Assignee: Nippon Steel Corporation, Tokyo, Japan

[ * ] Notice: The portion of the term of this patent subsequent to Oct. 6, 1998 has been disclaimed.

[21] Appl. No.: 408,737

[22] Filed: Aug. 17, 1982

Related U.S. Application Data

[60] Continuation of Ser. No. 214,035, Dec. 8, 1980, abandoned, which is a division of Ser. No. 58,757, Jul. 19, 1979, Pat. No. 4,293,350.

[30] Foreign Application Priority Data

Jul. 26, 1980 [JP] Japan ..... 55-91217

[51] Int. Cl.[4] ..... C22C 38/02

[52] U.S. Cl. ..... 148/31.5; 148/31.55; 428/611; 428/900; 75/123 L

[58] Field of Search ..... 148/110, 111, 112, 113, 148/120, 9.5, 31.55, 31.5; 428/900, 611; 75/123 L

[56] References Cited

U.S. PATENT DOCUMENTS

| | | | |
|---|---|---|---|
| 3,192,078 | 6/1965 | Gordon et al. | 148/100 |
| 3,647,575 | 3/1972 | Fiedler et al. | 148/111 |
| 3,856,568 | 12/1974 | Tanaka et al. | 148/12 A |
| 3,932,236 | 1/1976 | Wada et al. | 148/113 |
| 3,947,296 | 3/1976 | Kumazawa | 148/111 |
| 3,990,923 | 11/1976 | Takashina et al. | 148/111 |
| 4,063,063 | 12/1977 | Funck et al. | 148/9.5 |
| 4,130,447 | 12/1978 | Marianeschi et al. | 148/27 |
| 4,242,155 | 12/1980 | Morito et al. | 148/113 |

*Primary Examiner*—John P. Sheehan

*Attorney, Agent, or Firm*—Kenyon & Kenyon

[57] ABSTRACT

In a method of producing a grain-oriented electromagnetic steel sheet, a laser beam is irradiated onto the steel sheet, which has been subjected to a final high temperature annealing in order to approximate the crystal orientation of the sheet in a (110) [001] orientation. Because of the laser beam irradiation, regions of high dislocation density are locally formed in the steel sheet and subdivide the magnetic domains, with the result that a low watt loss is achieved.

26 Claims, 9 Drawing Figures

2mm

GRAIN-ORIENTED ELECTROMAGNETIC STEEL SHEET WITH IMPROVED WATT LOSS

This is a continuation of application Ser. No. 214,035 filed Dec. 8, 1980, now abandoned which is a division of Ser. No. 058,757 filed July 19, 1979 now U.S. Pat. No. 4,293,350 issued Oct. 6, 1981.

BACKGROUND OF THE INVENTION

The present invention relates to a method of producing a sheet of grain-oriented electromagnetic steel, particularly a sheet of grain-oriented electromagnetic steel with an improved watt loss property, as well as to the grain oriented electromagnetic steel sheet produced by such method.

There are two kinds of the grain-oriented electromagnetic steel sheets. However, only one kind is industrially produced for employment as the core material of transformers and various electric devices, and that kind is crystallographically designated as having a (110) [001] structure. This designation indicates that the (110) plane of the crystal grains of the steel sheet is parallel to the sheet surface, while the [001] direction of easy magnetization is parallel to the rolling direction of the steel sheet. In the actual steel sheets, the (110) plane of the crystal grains is deviated from the sheet surface, although at only a slight angle, and the [001] direction of the crystal grains is also deviated from the rolling direction at a slight angle. Since the excitation property and watt loss of the electromagnetic steel sheets are largely influenced by the degree of deviations mentioned above, a considerable amount of effort has been put into approximating the crystallographic orientation of all the crystal grains in the ideal (110) [001] orientation. As a result, it is currently possible to industrially produce electromagnetic steel sheets with a low watt loss of W17/50, which is equal to approximately 1.03 W/Kg with regard to a 0.30 mm thick sheet. The designation W17/50 indicates the watt loss under a condition of 1.7T of magnetic flux density and a frequency of 50 Hz.

Successive studies of electromagnetic steel sheet clarified that a prominent decrease of watt loss to a value lower than the value mentioned above cannot be achieved exclusively by means of approximating the crystal grains in the ideal orientation. Generally speaking, watt loss is dependent upon not only the excitation property, but also the crystal grain size of electromagnetic steel sheets. An excessive growth of crystal grains has been usually experienced in the prior efforts to improve the excitation property, and this has a tendency to counterbalance the amount of reduction in watt loss due to the improvement of excitation property. In short, it is not easy to achieve a prominent reduction in watt loss by conventional metallurgical means. Unless means different from metallurgical means for improving the watt loss is provided, the watt loss cannot be improved to a value lower than the conventional level.

It is known from U.S. Pat. No. 3856568 that one of the non metallurgical means for improving watt loss is to apply a tensile force to the steel sheets. As a means of applying tensile force, an insulating film is formed on the steel sheets. However, since the tensile force applied by means of the insulating film is limited, the watt loss value can be reduced to only about 1.03 W/Kg as a minimum, even by the aid of the tensile force effects.

Another non metallurgical means is known from U.S. Pat. No. 3647575. According to this patent, sharp scratches are formed on the surface of steel sheets by a knife, a blade of a razor, powder emery, a metal brush or the like. The watt loss reduction of a single sheet by the scratches can in fact be expected. However, since this process relies on a mechanical means, rising edges of unevenness are inevitably created on the sheet surface. Because of the intense unevenness as mentioned above not only is the space factor of the laminated sheets greatly decreased but also, the magnetostriction of the sheets is greatly increased. In addition to such disadvantages, there may arise such a serious disadvantage that a predetermined level of watt loss cannot be achieved with regard to the laminated sheet. In other words, the Epstein measurement value of the laminated sheets can be higher than a value measured by SST (measuring device for a single sheet). The reason for the watt loss reduction of the laminated sheets is understood to reside in the fact that the sheet thickness is locally reduced at the indentations of the scratches in the steel sheets, and hence, a part of the magnetic flux emanates from each of the steel sheets via the indentations into adjacent, upper and lower sheets. As a result, the watt loss deteriorates due to the thus generated magnetization component, which is perpendicular to the steel sheets. The method of mechanically forming the scratches on the surface of the steel sheets is not advisable when the sheets form a core of laminated steel sheets a for the reasons explained above and, therefore, is difficult to adopt practically.

As still another non metallurgical means, a method for mechanically applying minute strain on the surface of steel sheets is used to improve the watt loss. As is well known, the watt loss is divided into a hysteresis loss and an eddy current loss, which is further divided into a classical eddy current loss and anomalous loss. The classical eddy current loss is caused by an eddy current induced due to a constantly changing magnetization in a magnetic material and results in a loss of the magnetization as a heat. The anomalous loss is caused by the movement of the magnetic walls and is proportional to the square of the moving speed of the magnetic wall. Since such moving speed is proportional to the moving distance of the magnetic walls when the frequency of the external current is constant, the speed and, thus, the anomalous loss are increased with the increase in the width of magnetic domains. However, with the increase in the width of magnetic domains and, thus, the decrease in the number of magnetic walls, the anomalous loss is not proportional to the square of the width of the magnetic domains, but is approximately proportional to the width of the magnetic walls. The anomalous loss accounts for approximately 50% of the watt loss at a commercial frequency of 50 or 60 Hz, and the proportion of anomalous loss is increased due to the recent development of decreasing eddy current and hysteresis losses of grain oriented electromagnetic sheets. Since narrow magnetic domains are important for the decrease of the anomalous loss, a tension force is applied to the sheets, from which the surface film is removed, so as to decrease the width of the magnetic domains.

The prior art includes U.S. Pat. No. 3990923, which proposes to insert between the conventional, decarburization and final annealing steps an additional step of locally working the steel sheet, so as to alternately arrange on the sheet surface the worked and non worked regions. The additional working step may be carried out by local plastic working or a local heat treatment by radiation utilizing infrared rays, light rays, electron beams or laser beams. The regions worked by plastic working or heat treatment serve to inhibit the secondary recrystallization of the steel sheet during the final high temperature annealing. In the worked regions the secondary recrystallization starts at a temperature lower than in the non worked regions and, thus, the worked regions function to inhibit the growth of secondary recrystallization grains produced in the non worked regions.

SUMMARY OF THE INVENTION

It is an object of the present invention to decrease the watt loss of a sheet of grain-oriented electromagnetic steel, by using a new step, quite different from mechanical means used after final annealing and local working, which includes plastic deformation or heat treatment performed prior to the final annealing.

It is another object of the present invention to provide a novel means for decreasing the width of magnetic domains, which influences the anomalous loss, i.e. one factor of the watt loss.

It is a further object of the present invention to provide a process for producing, by a rather simple means, a grain-oriented electromagnetic steel sheet having a low watt loss.

It is still another object of the present invention to provide a grain-oriented electromagnetic steel sheet in which the magnetic domains are subdivided by a novel means.

The above-mentioned objects and other objects according to the present invention can be achieved by producing a sheet of grain-oriented electromagnetic steel by subjecting a steel sheet containing silicon to one or more operations of cold rolling and, if necessary, one or more operations of annealing, and also, to a step of subjecting to decarburization and final high-temperature annealing said sheet which is so cold-rolled and annealed into the thickness of a commercial standard, wherein the applicants' improvement involves the additional step of momentarily irradiating, by a laser beam, the surface of the grain-oriented electromagnetic sheet, which has been subjected to final high temperature annealing, in a crossing direction or directions to a rolling direction, thereby subdividing magnetic domains in the steel sheet and, thus, improving the watt loss of the grain-oriented electromagnetic steel sheet.

BRIEF DESCRIPTION OF THE DRAWINGS

The present invention is explained in detail with reference to the following drawings.

DESCRIPTION OF THE PREFEFRED EMBODIMENTS

Figure 1:
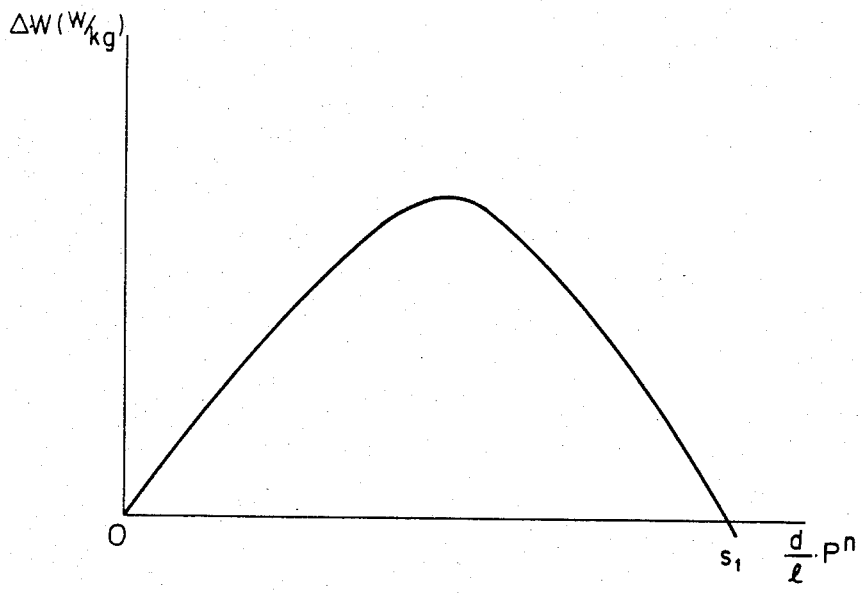
FIG. 1 is a graph illustrating a theoretical value of the watt loss reduction (ΔW).

The starting material of the grain-oriented electromagnetic sheet is a steel produced by such a known steel-making process as steel produced using a converter, an electric furnace or the like, which, is fabricated into a slab, and, further, hot-rolled into a hot-rolled coil. The hot-rolled steel sheet contains less than 4.5% of silicon and, if necessary, acid-soluble aluminum (Sol. Al) in an amount of 0.010 to 0.050% and sulfur in the amount of 0.010 to 0.035%, but there is no restriction about the composition except for the amount of silicon. The hot-rolled coil is subjected to a combination of one or more operations of cold rolling and, if necessary, one or more operations of intermediate annealing, so as to make the thickness of a commercial standard. The steel sheet which is so worked is subjected to decarburizing annealing in wet hydrogen atmosphere and, then, to final high-temperature annealing at more than 1100° C. for more than 10 hours. Thus, a grain-oriented electromagnetic steel sheet is produced. As a result of the final annealing, a secondary recrystallization takes place and the steel sheet is provided with a so called (110) [001] structure and coarse grains.

The present invention is characterized by irradiating with a laser beam, the surface of the steel sheet, which has been finally annealed, so that regions having a high density of dislocations are locally formed, with the result that minute plastic strain is applied to the steel sheet without any change in the shape of the sheet surface.

According to one of the irradiation methods according to the present invention, the laser irradiation is carried out in such a manner that a pulse laser beam having a width in the range of, for example, from approximately 0.1 to 1 mm, especially approximately 0.2 to 1 mm, is irradiated in a direction or directions almost perpendicular to the rolling direction. The time period for the momentary irradiation does not exceed approximately 10 ms (milliseconds), and should range from 1 ns (nanosecond) to 10 ms (millisecond). The distance between the adjacent irradiated zones ranges from 2.5 to 30 mm. The method described above should satisfy the irradiation condition, which falls within the range of the equation:

$$0.005 \leqq \frac{d}{l} \cdot p^2 \leqq 1.0,$$

which will be explained hereinbelow.

The following is explanation of the principles of the present invention.

The laser beam, which is used to irradiate the surface of the steel sheet, has an energy density which is expressed by P. The laser beam is absorbed by the steel sheet in a ratio of $\alpha$ which ranges from 0 to 1.

The compression stress $p_c$ generated in the steel sheet by the laser beam is expressed by:

$$p_c \propto \alpha' P \quad (1)$$

The density of dislocations $\rho$ formed in the steel sheet is:

$$\rho^{\frac{1}{n}} \alpha P_c, \tag{2}$$

wherein n is a constant.

The relationship between the energy density P and the dislocation density is therefore:

$$\alpha' P \alpha \rho^{\frac{1}{n}}, \tag{3}$$

The principle of the present invention is developed from a novel concept that nuclei of new magnetic walls are generated in the regions of high dislocation density and these new magnetic walls subdivide the magnetic domains. The generating probability of these nuclei or the number of the nuclei generated per a unit volume of the steel sheet is, therefore, considered to be proportional to the dislocation density $\rho$. Accordingly, the number of nuclei generated per unit length of the steel sheet, which has a predetermined constant thickness, is dependent upon the irradiation width (d) and the irradiation distance (l). Such number (m) means a generating density of nuclei and is expressed by:

$$m \propto \frac{d}{l} \rho, \tag{4}$$

The relationship between the generating density of nuclei (m) and the width (L) of magnetic domains, which are subdivided by the germs, is expressed by the equation:

$$\frac{1}{L} \propto m + \frac{1}{L_0}, \tag{5}$$

wherein $L_0$ indicates the value of L at m=0.

As may be understood from the explanation herein before of the prior art, the watt loss (W) has a positive correlation with the width (L) of magnetic domains. The regions of high dislocation density created by the laser irradiation bring about the disorder of magnetic walls in such regions. The watt loss is, therefore, proportionally increased with the increase in product of the volume (d/l) of the high dislocation regions and the dislocation density ($\rho$).

The watt loss of the steel sheet subjected to the laser irradiation is expressed by:

$$W = C_1 L + C_2' \frac{d}{l} \rho, \tag{6}$$

wherein $C_1$ and $C'_2$ are coefficients.

The reduction of watt loss due to the laser irradiation on the steel sheet is:

$$\Delta W = C_1 L_0 - \left( C_1 L + C_2 \frac{d}{l} \rho \right) = C_1 L_0 \left( 1 - \frac{1}{1 + \alpha L_0 \frac{d}{l} P^n} \right) - C_2 \frac{d}{l} \cdot P^n. \tag{7}$$

wherein $C_1$, $C_2$ and $\alpha$ are constant.

The equation (7), above, is illustrated in FIG. 1, in which the ordinate and abscissa indicate $\Delta W$ and $$\frac{d}{l} \cdot p^n,$$

respectively. As is apparent from in FIG. 1, $\Delta W$ is more than zero, namely the watt loss is decreased due to the laser irradiation, when the value of $$\frac{d}{l} \cdot p^n$$

is more than zero and less than $S_1$.

According to the present invention, which is based on the principle explained above, the laser beam is irradiated in such a manner that the irradiation satisfies the condition:

$$0.0005 \leqq \frac{d}{l} \cdot p^2 \leqq 1.0, \tag{8}$$

preferably, $$0.01 \leqq \frac{d}{l} \cdot p^2 \leqq 0.08, \tag{8'}$$

wherein d is the width of the laser beam in mm, P is the energy density of the laser beam in $J/cm^2$ and l is the irradiation distance in mm.

The laser device which can be used for carrying out the present invention may be any solid or gas laser, provided that the radiation energy is in the range of from 0.1 to 10 $J/cm^2$, and further that the oscillation pulse width is not more than 10 milliseconds. Accordingly, the ruby laser, YAG (Nd-Yittlium-Aluminum-Garnet) laser or nitrogen laser, which are commercially available at present, may be used to carry out the process of present invention.

When the pulse width and energy exceed the upper limits mentioned above, a thermal melting phenomenon is dominant, at the irradiated regions of the steel sheets, over the increasing effect of dislocation density due to the laser beam irradiation. As a result of the melting phenomenon, a change of crystal structure is induced at the irradiated regions, and hence, almost no improvement in the watt loss can be expected.

Figure 2:
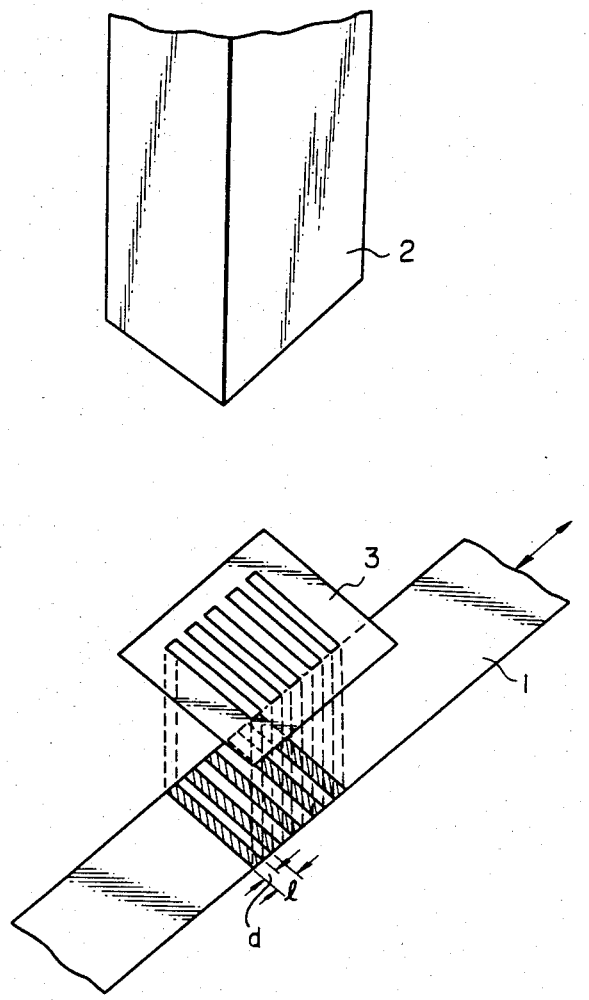
FIG. 2 schematically illustrates an embodiment of the process according to the present invention.

The electromagnetic steel sheet 1 may be irradiated by using the laser beam as shown in FIG. 2. The shielding plate 3 with slits is interposed between the pulse laser ray apparatus 2 and the electromagnetic steel sheet. The laser beam is directed from the apparatus 2 in the direction perpendicular to the sheet surface as an irradiation pattern extending at a right angle to the rolling direction shown by the double arrow. The irradiated regions shown by hatching have a width (d) and a distance (l).

Figure 3:
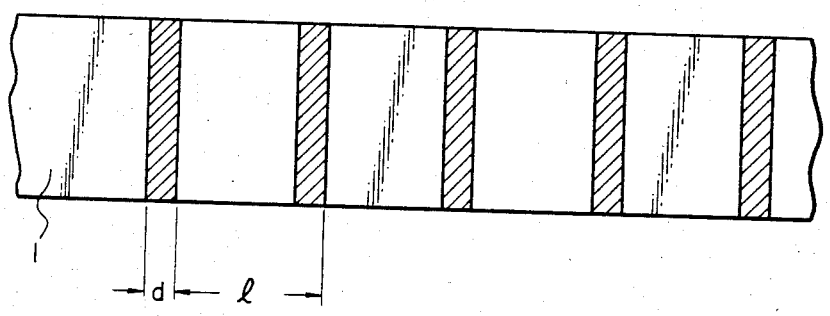
FIG. 3 illustrates an irradiation pattern of a laser beam according to an embodiment of the process of the present invention.

As will be apparent from FIG. 3, the term "irradiation distance" (l) used herein indicates the distance between the end of one irradiated region and the end of an adjacent irradiated region, the latter end being on the same side as the former end.

Figure 4:
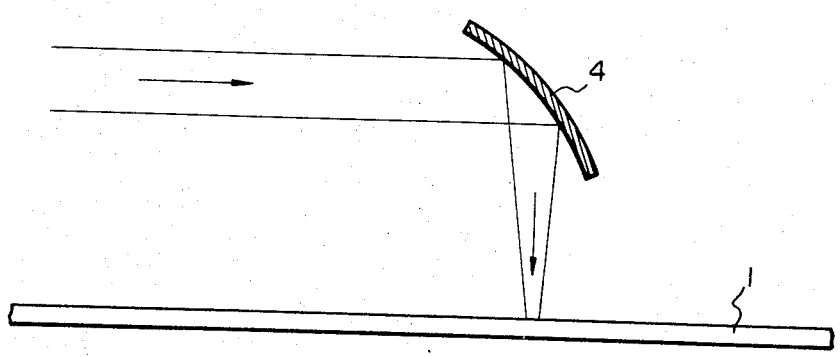
FIG. 4 schematically illustrates another embodiment of the process according to the present invention.

The laser beam may be irradiated by using a reflection mirror system 4, as shown in FIG. 4. The laser beam is condensed by the reflection mirror system 4 and, then, is irradiated onto the steel sheet 1 in the form of a strip. A number of the irradiated regions having the same or different distances therebetween are formed by repeating the irradiation procedure mentioned above.

Figure 5:
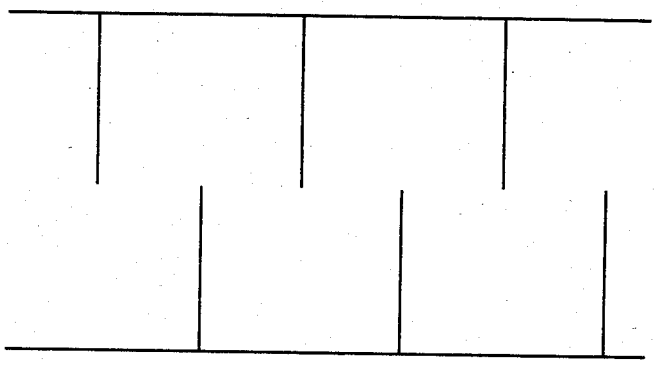
FIGS. 5 and 6 illustrate other irradiation patterns of a laser beam.
Figure 6:
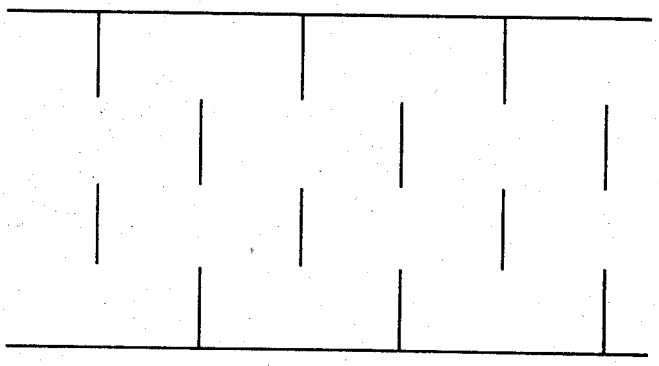

A lens and the like may be used instead of the mirror system 4. Furthermore, instead of arranging the irradiated regions over the entire width of the steel sheet as continuous straight lines, the laser beam may be alternately irradiated in a pattern of a discontinuous zigzag form as seen in FIGS. 5 and 6.

In the irradiation procedure explained above, the laser beam is irradiated in such a manner that it crosses the rolling direction at vertical angle. A vertical crossing angle is preferable, but the crossing angle may not be an exact vertical angle and be deviated therefrom by an angle of 30° at the maximum.

Figure 8B:
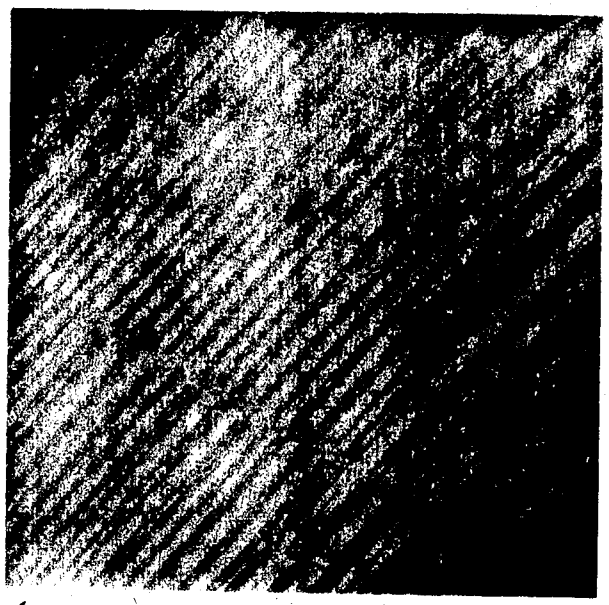
FIGS. 8A and 8B are photographs by a scanning type electron microscope indicating a subdivision of magnetic domains by means of the laser beam irradiation.
Figure 8A:
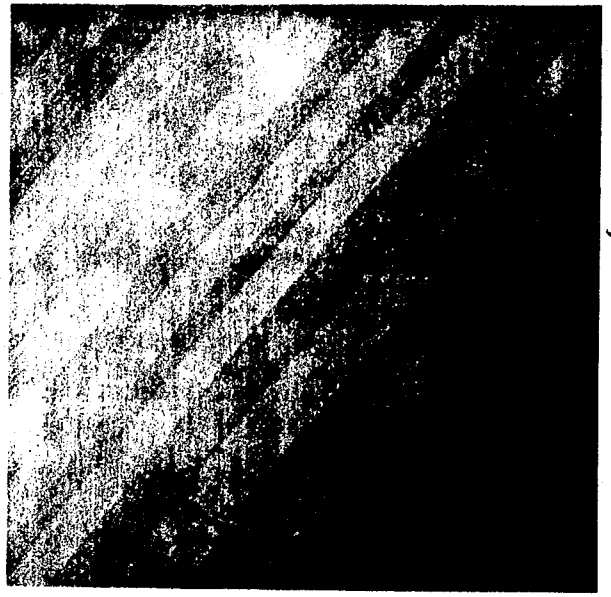

In any of the irradiation methods illustrated in FIGS. 2 through 6, minute strains are generated on the surface of steel sheet, with the result that magnetic domains are subdivided. Referring to FIGS. 8A and 8B, the grain-oriented electromagnetic steel sheet is rolled in the direction denoted by the double arrow a, finally annealed and irradiated by a laser beam in the direction and location shown by the arrows b. As a result of the laser irradiation, micro strains are generated on the regions shown by the arrows b and the widths of magnetic domains at both sides of these regions are subdivided due to the minute strains. It should be noted that the magnetic domains are subdivided in a direction perpendicular to the irradiation direction of the laser beam. As will be apparent from a comparison of FIGS. 8A and 8B, the magnetic domain subdivision effect is more outstanding in FIG. 8B than in FIG. 8A.

The laser beam irradiation according to the present invention is effective for the subdivision of the magnetic domains irrespective of the surface quality of the steel sheet. Namely, the surface of the steel sheet may be a rolled or polished, mirror surface and may be covered by a known insulating film. The steel sheet may, therefore, be irradiated after the application of the insulating film. The laser beam can advantageously be irradiated after the covering of the steel sheet with the insulating film so as to generate minute strains in the sheet, without destroying the insulating film completely. The process according to the present invention is more effective for reducing the watt loss than the conventional, marking-off process or scratching process, in which processes the indentations are formed on the insulating film, which is destroyed due to the scratching and the like.

The reduction of watt loss due to the irradiation of the laser beam under the various conditions is illustrated in Table 1. From Table 1, the irradiation conditions for effectively reducing the watt loss will be apparent.

TABLE 1

| Irradiation Width (mm) | Irradiation Energy (J/cm²) 0.5~1.4 Irradiation Distance (mm) 2.5 | 5 | 10 | 20 | 30 | 1.5~2.5 Irradiation Distance (mm) 2.5 | 5 | 10 | 20 | 30 |
|---|---|---|---|---|---|---|---|---|---|---|
| 0.1 | | Δ | x | | | | o | Δ | | |
| 0.25 | o | Δ | x | | | | o | o | Δ | |
| 0.5 | o | Δ | Δ | Δ | x | o | o | | o | Δ |
| 1.0 | x | o | o | Δ | Δ | xx | Δ | o | | |
| 2.0 | | x | | | | | xx | | | |

Remarks:
xx $\Delta W \leqq 0$
x $0 < \Delta W \leqq 0.03$
Δ $0.03 < \Delta W \leqq 0.06$
o $0.06 < \Delta W \leqq 0.09$
$0.09 < \Delta W$ As will be apparent from Table 1, above, the watt loss can be reduced by selecting the irradiation conditions so that they are within the ranges of: an irradiation energy or energy density (P) of from 0.5 to 2.5 J/cm²; an irradiation distance (l) of from 2.5 to 30 mm, and; an irradiation width (d) of from 0.1 to 2.0 mm.

Figure 7:
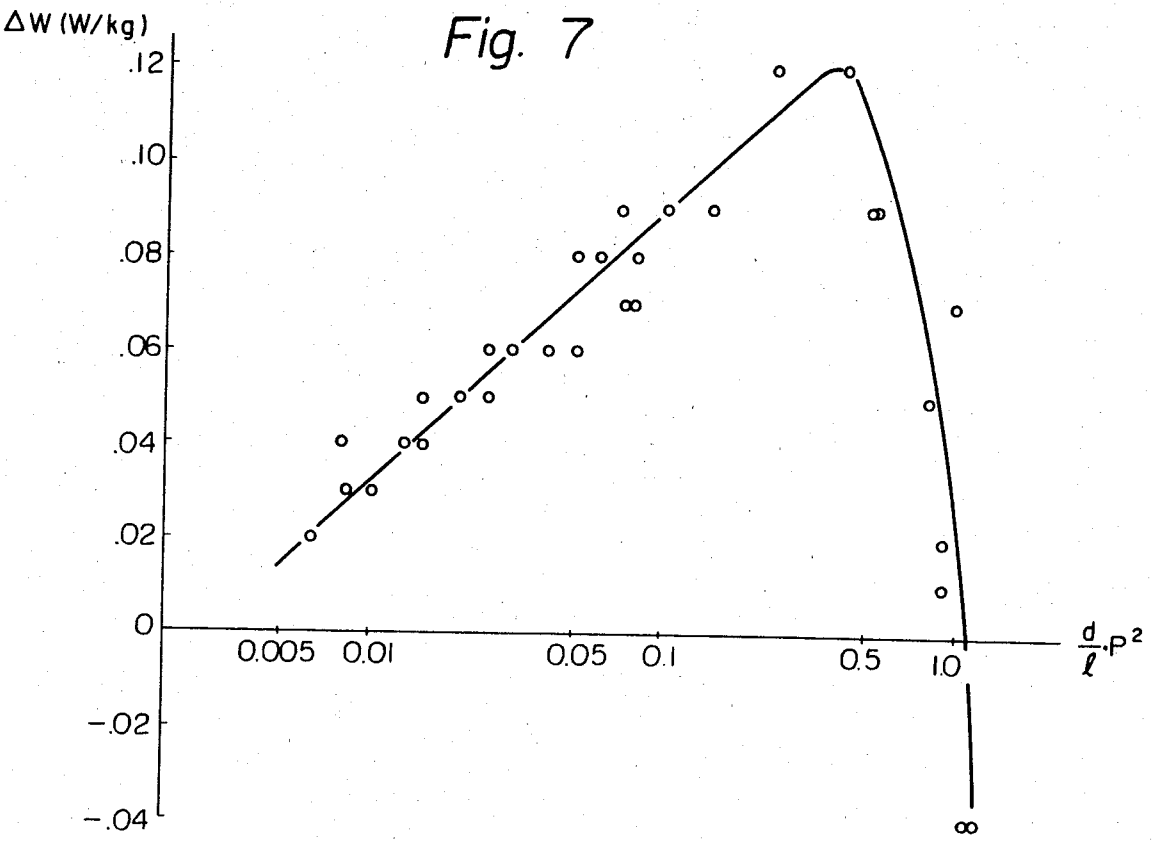
FIG. 7 is a graph illustrating an example of the watt loss reduction (ΔW).

The results of the watt loss reduction (ΔW) as shown in Table 1 are illustrated in a graph in FIG. 7, wherein the abscissa and ordinate indicate $$\frac{d}{l} \cdot p^2$$

and the reduction of watt loss (ΔW), respectively. The watt loss is appreciably reduced at the value of $\Delta W = 0.02$ W/Kg. The value of $$\frac{d}{l} \cdot p^2$$

corresponding to an ΔW of 0.02 W/Kg is 0.005 J²/cm⁴ at the minimum and 1.0 J²/cm⁴ at the maximum.

In order to improve the quality of the grain-oriented electromagnetic steel sheet more than one grade, it is necessary to increase the ΔW value to 0.04 or more by carrying out the laser beam irradiation under the condition that the value of $$\frac{d}{l} \cdot p^2$$

ranges from 0.01 to 0.8. The watt loss reduction (ΔW) is further increased to 0.08 or more and, therefore, the watt loss property can be remarkably enhanced, by adjusting the value of $$\frac{d}{l} \cdot p^2$$

to within the range of from 0.08 to 0.60. The watt loss reduction (ΔW) is furthermore increased to 0.10 or more by adjusting the value of $$\frac{d}{l} \cdot p^2$$

so that it is within the range of from 0.20 to 0.40.

It is possible to reliably produce by the conventional methods a grain-oriented electromagnetic steel sheet having a watt loss in the range of from 1.05 to 1.14 W/Kg. The watt loss of the electromagnetic steel sheet may be from 0.95 to 1.12 W/Kg. Such watt loss can be reduced by irradiating with a laser beam used according to the present invention to a value of from 1.03 to 1.12, at a $$\frac{d}{l} \cdot p^2$$

of from 0.01 to 0.8, preferably to a value of from 0.97 to 1.06, at $$\frac{d}{l} \cdot p^2$$

of from 0.08 to 0.60, and more prefereably, to a value of from 0.95 to 1.04 W/Kg, at $$\frac{d}{l} \cdot p^2$$

of 0.2 to 0.4. A considerably low watt loss in the range of 0.95 to 1.00 can be achieved by adjusting the value of $$\frac{d}{l} \cdot p^2$$

to approximately from 0.4 to 0.5.

The present invention will hereinafter be explained by way of Examples.

EXAMPLE 1

A 1100 mm wide sheet of hot-rolled steel containing 0.051% of carbon, 2.92% of silicon, 0.026% of sulfur and 0.027% of acid soluble aluminum, was subjected to annealing at 1120° C. for 2 minutes, cold-rolled to a thickness of 0.30 mm, and decarburized at 850° C. in a wet hydrogen atmosphere for 4 minutes. The sheet was finally subjected to a high temperature annealing at 1200° C. for 20 hours. As a result of the processs mentioned above, the thus obtained (110) [001] grain-oriented electromagnetic steel sheet exhibited a magnetic flux density $B_8$ of 1.935T and a watt loss value W17/50 of 1.10 W/Kg.

Using a commercially available pulse laser having a pulse width of approximately 30 ns, the steel sheet was subsequently irradiated by the laser beam in the perpendicular direction of the rolling direction under the conditions of:

an energy density of the pulse laser beam (P) of 0.8 J/cm$^2$;

an irradiation distance (l) of 10 mm;

an irradiation width (d) of 0.1 mm, and;

a $$\frac{d}{l} \cdot p^2$$

of 0.0064.

The irradiation width (d) was established by the aid of the slits in the shielding plate 3 illustrated in FIG. 2.

The magnetic flux density $B_8$ and the watt loss value W17/50 after the irradiation were 1.934T and 1.08 W/Kg, respectively. Accordingly, the watt loss reduction ($\Delta$W) was 0.02 W/Kg, which is the lowest appreciable reduction.

EXAMPLE 2

A 1100 mm wide sheet of hot-rolled steel containing 0.048% of carbon, 2.90% of silicon, 0.025% of sulfur and 0.028% of acid soluble aluminum, was subjected to annealing at 1120° C. for 2 minutes, cold rolled to a thickness of 0.30 mm, and decarburized at 850° C. in a wet hydrogen atmosphere for 4 minutes. The sheet was finally subjected to a high temperature annealing at 1200° C. for 20 hours. As a result of the process mentioned above, the thus obtained (110) [001] grain-oriented electromagnetic steel sheet exhibited a magnetic flux density of 1.954' and a watt loss value W17/50 of 1.06 W/Kg.

The steel sheet was thereafter irradiated by the laser beam, by scanning the laser beam in a direction perpendicular to the rolling direction under the conditions of:

an energy density of pulse laser beam (P) of 2.0 J/cm$^2$;

an irradiation distance (l) of 2.5 mm;

an irradiation width (d) of 0.25 mm, and;

a $$\frac{d}{l} \cdot p^2$$

of 0.4.

The magnetic flux density $B_8$ and the watt loss value W17/50 after the irradiation were 1.952T and 0.96 W/Kg, respectively. Accordingly, the watt loss reduction ($\Delta$W) was 0.12 W/Kg, which value is sufficient for enhancing the quality of an electromagnetic steel sheet one or more grades.

EXAMPLE 3

A 1100 mm wide sheet of hot-rolled steel containing 0.045% of carbon, 2.90% of silicon, 0.025% of sulfur and 0.027% of acid soluble aluminum, was subjected to annealing at 1120° C. for 2 minutes, cold rolled to a thickness of 0.30 mm, and decarburized at 850° C. in a wet hydrogen atmosphere for 4 minutes. The sheet was subjected to a final high temperature annealing at 1200° C. for 20 hours. Finally, a conventional insulating film was deposited on the steel sheet. As a result of the process mentioned above, the thus obtained (110) [001] grain-oriented electromagnetic steel sheet exhibited a magnetic flux density of 1.927T a watt loss value W17/50 of 1.05 W/Kg.

The steel sheet was thereafter irradiated by the laser beam, by scanning the laser beam in a direction perpendicular to the rolling direction under the conditions of:

an energy density of pulse laser beam (P) of 2.0 J/cm$^2$;

an irradiation distance (l) of 10 mm;

an irradiation width (d) of 0.1 mm, and;

a $$\frac{d}{l} \cdot p^2$$

of 0.04.

The magnetic flux density $B_8$ and the watt loss value W17/50 after the irradiation were 1.925T and 1.05 W/Kg, respectively. Accordingly, the watt loss reduction ($\Delta$W) was 0.06 W/Kg.

EXAMPLE 4

A 1100 mm wide sheet of hot-rolled steel containing 0.048% of carbon, 3.00% of silicon, 0.024% of sulfur and 0.026% of acid soluble aluminum, was subjected to annealing at 1120° C. for 2 minutes, cold rolled to a thickness of 0.35 mm, and decarburized at 850° C. in a wet hydrogen atmosphere for 4 minutes. The sheet was finally subjected to a high temperature annealing at 1200° C. for 20 hours. As a result of the process mentioned above, the thus obtained (110) [001] grain-oriented electromagnetic steel sheet exhibited a magnetic flux density $B_8$ of 1.926T and a watt loss value W17/50 of 1.14 W/Kg.

The steel sheet was irradiated by the laser beam, in accord with the present invention by scanning the laser beam in a direction perpendicular to the rolling direction under the conditions of:

an energy density of pulse laser beam (P) of 1.5 J/cm$^2$;

an irradiation distance (l) of 10 mm;

an irradiation width (d) of 0.25 mm, and;

a $$\frac{d}{l} \cdot p^2$$

of 0.056.

The magnetic flux density $B_8$ and the watt loss value W17/50 after the irradiation were 1.926T and 1.06 W/Kg, respectively. Accordingly, the watt loss reduction (ΔW) was 0.08 W/Kg.

EXAMPLE 5

(control)

A 1100 mm wide sheet of hot-rolled steel containing 0.045% of carbon, 2.90% of silicon, 0.025% of sulfur and 0.026% of acid soluble aluminum, was subjected to annealing at 1120° C. for 2 minutes, cold rolled to a thickness of 0.30 mm, and decarburized at 850° C. in a wet hydrogen atmosphere for 4 minutes. The sheet was finally subjected to a high temperature annealing at 1200° C. for 20 hours. As a result of the process mentioned above, the thus obtained (110) [001] grain-oriented electromagnetic steel sheet exhibited a magnetic flux density $B_8$ of 1.943T and a watt loss value W17/50 of 1.02 W/Kg.

The steel sheet was thereafter irradiated by the laser beam, by scanning the laser beam in a direction perpendicular to the rolling direction under the conditions of:

an energy density of pulse laser beam (P) of 1.7 J/cm$^2$;

an irradiation distance (l) of 5 mm;

an irradiation width (d) of 2 mm, and;

a $$\frac{d}{l} \cdot p^2$$

of 1.16.

The magnetic flux density $B_8$ and the watt loss value W17/50 after the irradiation were 1.942T and 1.06 W/Kg, respectively. Accordingly, the watt loss reduction (ΔW) was increased in an amount 0.04 W/Kg, due to the irradiation.

What we claim is:

1. A grain-oriented silicon steel electrical sheet with a reduced watt loss wherein said sheet has been cold rolled to a final thickness and finally high temperature annealed, said steel sheet having:

a (110) [001] structure and coarse grains;

a plurality of spaced apart lines of laser beam irradiation extending across said sheet and thereby extending across said coarse grains with said lines of laser beam irradiation being produced by irradiating said sheet with a laser beam after final high temperature annealing;

wherein said lines of laser beam irradiation are oriented across the rolling direction of said sheet; and the surface of said sheet is not damaged by said laser beam irradiation and does not have raised edges adjacent said lines of laser beam irradiation caused by said irradiation with said laser beam; and with said sheet further having:

subdivided magnetic domains between each of two lines of laser beam irradiation wherein said subdivided magnetic domains are formed by said laser beam irradiation.

2. A grain-oriented silicon steel electrical sheet as recited in claim 1 wherein said lines of laser beam irradiation are oriented at an angle of 90° plus or minus 30° with respect to the direction of rolling of said sheet.

3. A grain-oriented silicon steel electrical sheet as recited in claim 1 or 2 wherein said spaced-apart lines of laser beam irradiation extend across said sheet with a spacing of 2.5 mm to 30 mm between adjacent lines.

4. A grain-oriented silicon steel sheet as recited in claim 3 wherein said spaced-apart lines of laser beam irradiation are oriented at an angle of 90° with respect to the direction of rolling of said sheet.

5. A grain-oriented silicon steel sheet as recited in claim 1 or 2 wherein said lines of laser beam irradiation are produced by a laser beam having an energy of 0.1 to 10 J/cm$^2$.

6. A grain-oriented silicon steel sheet as recited in claim 3 wherein said lines of laser beam irradiation are produced by a laser beam having an energy of 0.1 to 10 J/cm$^2$.

7. A grain-oriented silicon steel sheet as recited in claim 1 or 2 wherein said subdivided magnetic domains are perpendicular to said lines of laser beam irradiation.

8. A grain-oriented silicon steel sheet as recited in claim 3 wherein said subdivided magnetic domains are perpendicular to said lines of laser beam irradiation.

9. A grain-oriented silicon steel sheet as recited in claim 5 wherein said subdivided magnetic domains are perpendicular to said lines of laser beam irradiation.

10. A grain-oriented silicon steel sheet as recited in claim 6 wherein said subdivided magnetic domains are perpendicular to said lines of laser beam irradiation.

11. A grain-oriented silicon steel sheet as recited in claim 1 or 2 wherein said lines of laser beam irradiation are parallel to one another.

12. A grain-oriented silicon steel sheet as recited in claim 9 wherein said lines of laser beam irradiation are parallel to one another.

13. A grain-oriented silicon steel sheet as recited in claim 10 wherein said lines of laser beam irradiation are parallel to one another.

14. A grain-orientd silicon steel electrical sheet with a reduced watt loss wherein said steel sheet has been cold rolled to a final thickness and finally high temperature annealed, said steel sheet having:

a (110) [001] structure and coarse grains; insulating film on the surface of said sheet;

a plurality of spaced-apart lines of laser beam irradiation extending across said insulating film and across said sheet and thereby extending across said coarse grains with said lines of laser beam irradiation being produced by irradiating said sheet having said insulating film on the surface thereof with a laser beam after final high temperature annealing and after application of insulating film on the surface of said sheet; wherein said lines of laser beam irradiation are oriented across the rolling direction of said sheet; and said surface of said silicon steel sheet is not damaged by said laser beam irradiation and said silicon steel sheet does not have raised edges adjacent said lines of laser beam irradiation caused by said irradiation with said laser beam; and with said sheet further having:

subdivided magnetic domains between each of two lines of laser beam irradiation wherein said subdivided magnetic domains are formed by said laser beam irradiation.

15. A grain-oriented silicon steel electrical sheet as recited in claim 14 wherein said lines of laser beam irradiation are oriented at an angle of 90° plus or minus 30° with respect to the direction of rolling of said sheet.

16. A grain-oriented silicon steel electrical sheet as recited in claim 14 or 15 wherein said spaced-apart lines of laser beam irradiation extend across said steel sheet having said insulating film on the surface thereof with a spacing of 2.5 mm to 30 mm between adjacent lines.

17. A grain-oriented silicon steel electrical sheet as recited in claim 16 wherein said spaced apart lines of laser beam irradiation are oriented at an angle of 90° with respect to the direction of rolling of said sheet.

18. A grain-oriented silicon steel sheet as recited in claim 14 or 15 wherein said lines of laser beam irradiation are produced by a laser having an energy of 0.1 to 10 $J/cm^2$.

19. A grain-oriented silicon steel sheet as recited in claim 16 wherein said lines of laser beam irradiation are produced by a laser beam having an energy of 0.1 to 10 $J/cm^2$.

20. A grain-oriented silicon steel sheet as recited in claim 14 or 15 wherein said subdivided magnetic domains are perpendicular to said lines of said laser beam irradiation.

21. A grain-oriented silicon steel sheet as recited in claim 16 wherein said subdivided magnetic domains are perpendicular to said lines of laser beam irradiation.

22. A grain-oriented silicon steel sheet as recited in claim 18 wherein said subdivided magnetic domains are perpendicular to said lines of said laser beam irradiation.

23. A grain-oriented silicon steel sheet as recited in claim 19 wherein said subdivided magnetic domains are perpendicular to said lines of laser beam irradiation.

24. A grain-oriented silicon steel sheet as recited in claim 14 or 15 wherein said lines of laser beam irradiation are parallel to one another.

25. A grain-oriented silicon steel sheet as recited in claim 22 wherein said lines of laser beam irradiation are parallel to one another.

26. A grain-oriented silicon steel sheet as recited in claim 23 wherein said lines of laser beam irradiation are parallel to one another.

* * * * *